US006289761B1

(12) United States Patent
Reynolds et al.

(10) Patent No.: US 6,289,761 B1
(45) Date of Patent: Sep. 18, 2001

(54) AUTOMATIC ADJUSTABLE BRAKE, CLUTCH AND ACCELERATOR PEDALS

(75) Inventors: Dean William Reynolds, Boyne Falls; Martin Joseph Wortmann, Clarkston, both of MI (US)

(73) Assignee: Dura Global Technologies, Inc., Rochester Hills, MI (US)

( * ) Notice: Subject to any disclaimer, the term of this patent is extended or adjusted under 35 U.S.C. 154(b) by 0 days.

(21) Appl. No.: 09/498,594

(22) Filed: Feb. 4, 2000

(51) Int. Cl.[7] ..... G05G 1/14
(52) U.S. Cl. ..... 74/512
(58) Field of Search ..... 74/512, 513, 514, 74/560

(56) References Cited

U.S. PATENT DOCUMENTS

| | | | | |
|---|---|---|---|---|
| 3,975,972 | | 8/1976 | Muhleck . | |
| 4,497,399 | | 2/1985 | Kopich . | |
| 4,683,977 | | 8/1987 | Salmon . | |
| 4,870,871 | | 10/1989 | Iyan . | |
| 4,875,385 | * | 10/1989 | Sitrin | 74/512 |
| 4,989,474 | | 2/1991 | Cicotte et al. . | |
| 5,010,782 | | 4/1991 | Asano et al. . | |
| 5,078,024 | | 1/1992 | Cicotte et al. . | |
| 5,351,573 | | 10/1994 | Cicotte . | |
| 5,460,061 | | 10/1995 | Redding et al. . | |
| 5,632,183 | | 5/1997 | Rixon et al. . | |
| 5,722,302 | | 3/1998 | Rixon et al. . | |
| 5,771,752 | | 9/1998 | Cicotte . | |
| 5,819,593 | | 10/1998 | Rixon et al. . | |
| 5,823,064 | | 10/1998 | Cicotte . | |
| 5,855,143 | | 1/1999 | Ewing . | |
| 5,901,614 | | 5/1999 | Ewing . | |
| 5,913,946 | | 9/1999 | Ewing . | |
| 5,964,125 | | 10/1999 | Rixon et al. . | |
| 5,996,438 | * | 12/1999 | Elton | 74/512 |
| 6,019,015 | * | 2/2000 | Elton | 74/512 X |
| 6,151,985 | * | 11/2000 | Garber et al. | 74/512 |

* cited by examiner

*Primary Examiner*—Mary Ann Green
(74) *Attorney, Agent, or Firm*—Porter, Wright, Morris & Arthur

(57) ABSTRACT

An adjustable control pedal for a motor vehicle includes a link having an inclined slot formed therein, a screw supported by the link, a motor operatively connected to the screw to selectively rotate the screw about a central axis, and a nut threadably engaging the screw and adapted to move axially along the screw upon rotation of the screw. A pedal aim includes upper and lower pedal arms operatively connected for extension and retraction of the lower pedal arm relative to the upper pedal arm. The upper pedal arm is pivotally connected relative to the link. The lower pedal arm has a pedal at a lower end and a pin extending into the inclined slot. The pin is operatively connected to the nut so that the pin moves along the slot as the nut travels along the screw. The pedal arm rotates relative to the link and the lower pedal arm extends or retracts relative to the upper pedal arm as the pin moves along the inclined slot such that the pedal moves along a generally linear and horizontal path upon rotation of the screw. A second embodiment of the invention is disclosed which includes a link having first and second arcuate and inclined slots formed therein. A one-piece pedal arm is operatively connected to the nut. The pedal arm has a pedal at a lower end and first and second pins extending into the first and second inclined slots respectively so that the first and second pins move along the first and second slots respectively as the nut travels along the screw. The pedal arm rotates relative to the link as the first and second pins move along the first and second slots respectively such that the pedal moves along a generally linear and horizontal path upon rotation of the screw.

16 Claims, 2 Drawing Sheets

AUTOMATIC ADJUSTABLE BRAKE, CLUTCH AND ACCELERATOR PEDALS

FIELD OF THE INVENTION

The present invention generally relates to an improved control pedal for a motor vehicle and, more particularly, to a control pedal for a motor vehicle which is selectively adjustable to desired positions.

BACKGROUND OF THE INVENTION

Control pedals are typically provided in a motor vehicle, such as an automobile, which are foot operated by the driver. Separate control pedals are provided for operating brakes and an engine throttle. When the motor vehicle has a manual transmission, a third control pedal is provided for operating a transmission clutch. A front seat of the motor vehicle is typically mounted on tracks so that the seat is forwardly and rearwardly adjustable along the tracks to a plurality of positions so that the driver can adjust the front seat to the most advantageous position for working the control pedals.

This adjustment method of moving the front seat along the tracks generally fills the need to accommodate drivers of various size, but it raises several concerns. First, this adjustment method still may not accommodate all drivers due to very wide differences in anatomical dimensions of drivers. Second, the position of the seat may be uncomfortable for some drivers. Therefore, it is desirable to have an additional or alternate adjustment method to accommodate drivers of various size.

Many proposals have been made to selectively adjust the position of the control pedals relative to the steering wheel and the front seat in order to accommodate drivers of various size. It would be readily apparent to those skilled in the art that these adjustable control pedals can actuate both conventional cable controls and electronic throttle controls (ETC), because the ETC is a function separate from adjustability and the ETC module would typically be positioned remote from the mechanism for adjustment of the control pedals. U.S. Pat. Nos. 5,632,183, 5,697,260, 5,722,302, 5,819,593, 5,937,707, and 5,964,125, the disclosures of which are expressly incorporated herein in their entirety by reference, each disclose an example of an adjustable control pedal assembly. This control pedal assembly includes a hollow guide tube, a rotatable screw shaft coaxially extending within the guide tube, a nut in threaded engagement with the screw shaft and slidable within the guide tube, and a control pedal rigidly connected to the nut. The control pedal is moved forward and rearward when an electric motor rotates the screw shaft to translate the nut along the screw shaft within the guide tube. While this control pedal assembly may adequately adjust the position of the control pedal to accommodate drivers of various size, this control pedal assembly is relatively complex and expensive to produce. The relatively high cost is particularly due to the quantity of high-precision machined parts such as, for example, the guide tube and due to the quantity of welded joints. Accordingly, there is a need in the art for an adjustable control pedal assembly which selectively adjusts the position of the pedal to accommodate drivers of various size, is relatively simple and inexpensive to produce, and is highly reliable to operate.

SUMMARY OF THE INVENTION

The present invention provides an adjustable control pedal for a motor vehicle which overcomes at least some of the above-noted problems of the related art. According to the present invention, a control pedal includes, in combination, a link having a slot formed therein, a screw supported by the link, a motor operatively connected to the screw to selectively rotate the screw about a central axis, and a nut threadably engaging the screw and adapted to move axially along the screw upon rotation of the screw. A pedal arm is operatively connected to the nut. The pedal arm has a pedal and a pin extending into the inclined slot which moves along the slot as the nut travels along the screw. The pedal arm rotates relative to the link as the pin moves along the slot and the pedal moves along a generally linear path as the pin moves along the slot.

According to another aspect of the present invention, the control pedal includes, in combination, a link having a slot formed therein, a screw supported by the link, a motor operatively connected to the screw to selectively rotate the screw about a central axis, and a nut threadably engaging the screw and adapted to move axially along the screw upon rotation of the screw. A pedal arm comprises upper and lower pedal arms operatively connected for extension and retraction of the lower pedal arm relative to the upper pedal arm. The upper pedal arm is pivotally connected relative to the link. The lower pedal arm has a pedal at a lower end and a pin extending into the slot. The pin is operatively connected to the nut so that the pin moves along the slot as the nut travels along the screw. The pedal arm rotates relative to the link and the lower pedal arm translates relative to the upper pedal arm as the pin moves along the slot and the pedal moves along a generally linear path as the pin moves along the slot.

According to yet another aspect of the present invention, a control pedal includes, in combination, a link having first and second slots formed therein, a screw supported by the link, a motor operatively connected to the screw to selectively rotate the screw about a central axis, and a nut threadably engaging the screw and adapted to move axially along the screw upon rotation of the screw. A pedal arm is operatively connected to the nut. The pedal arm has a pedal and first and second pins extending into the first and second slots respectively so that the first and second pins move along the first and second slots respectively as the nut travels along the screw. The pedal arm rotates relative to the link as the first and second pins move along the first and second slots respectively and the pedal moves along a generally linear path as the first and second pins move along the first and second slots respectively.

From the foregoing disclosure and the following more detailed description of various preferred embodiments it will be apparent to those skilled in the art that the present invention provides a significant advance in the technology and art of control pedal assemblies. Particularly significant in this regard is the potential the invention affords for providing a high quality, feature-rich, low cost assembly. Additional features and advantages of various preferred embodiments will be better understood in view of the detailed description provided below.

BRIEF DESCRIPTION OF THE DRAWINGS

These and further features of the present invention will be apparent with reference to the following description and drawings, wherein.

Figures 1, 2, 3:
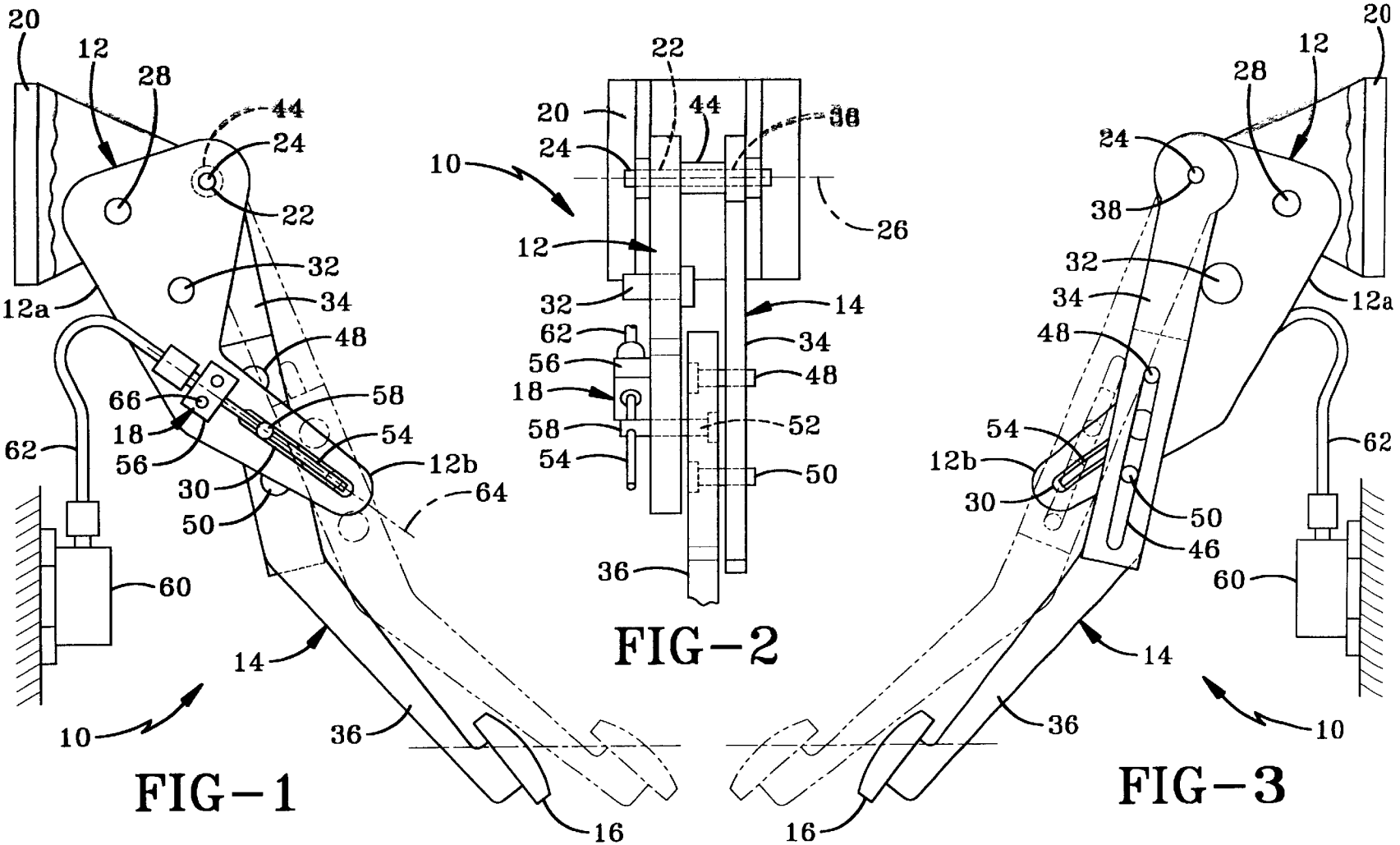
FIG. 1 is a left side elevational view of an adjustable control pedal according a first embodiment of the present invention.
FIG. 2 is a fragmented, rear elevational view of the adjustable control pedal of FIG. 1.
FIG. 3 is a right side elevational view of the adjustable control pedal of FIGS. 1 and 2.

It should be understood that the appended drawings are not necessarily to scale, presenting a somewhat simplified representation of various preferred features illustrative of the basic principles of the invention. The specific design features of a control pedal assembly as disclosed herein, including, for example, specific dimensions of the pedal arms and slots will be determined in part by the particular intended application and use environment. Certain features of the illustrated embodiments have been enlarged or distorted relative to others to facilitate visualization and clear understanding. In particular, thin features may be thickened, for example, for clarity or illustration. All references to direction and position, unless otherwise indicated, refer to the orientation of the control pedal assembly illustrated in the drawings. In general, up or upward refers to an upward direction in the plane of the paper in FIGS. 1 and 4 and down or downward refers to a downward direction in the plane of the paper in FIGS. 1 and 4. Also in general, fore or forward refers to a direction toward the front of the motor vehicle, that is, to the left in the plane of the paper in FIGS. 1 and 4 and aft or rearward refers to a direction toward the rear of the motor vehicle , that is, to the right in the plane of the paper in FIGS. 1 and 4.

DETAILED DESCRIPTION OF CERTAIN PREFERRED EMBODIMENTS

It will be apparent to those skilled in the art, that is, to those who have knowledge or experience in this area of technology, that many uses and design variations are possible for the improved adjustable control pedals disclosed herein. The following detailed discussion of various alternative and preferred embodiments will illustrate the general principles of the invention with reference to an adjustable control pedal for use with a motor vehicle. Other embodiments suitable for other applications will be apparent to those skilled in the art given the benefit of this disclosure.

Referring now to the drawings, FIGS. 1–3 show an adjustable control pedal 10 for a motor vehicle, such as an automobile, according to the present invention which is selectively adjustable to a desired forward/rearward position by a motor vehicle operator or driver. While the illustrated embodiments of the present invention are particularly adapted for use with an automobile, it is noted that the present invention can be utilized with any vehicle having at least one foot operated control pedal including trucks, buses, vans, recreational vehicles, earth moving equipment and the like, off road vehicles such as dune buggies and the like, air borne vehicles, and water borne vehicles.

The adjustable control pedal 10 can be adapted as a brake, clutch, accelerator, or other desired pedal. While a single adjustable control pedal 10 is illustrated, it is noted that two control pedals 10 can be utilized together within the scope of the present invention such as, for example, control pedals 10 adapted as brake and accelerator pedals respectively. It is also noted more than two control pedals 10 can be utilized together within the scope of the present invention such as, for example, three control pedals 10 adapted as clutch, brake and accelerator pedals respectively. The control pedal 10 is selectively adjustable by the motor vehicle operator in a forward/rearward direction as described in more detail hereinafter. When more than one adjustable control pedal 10 is utilized, the control pedals 10 are preferably adjusted together simultaneously to maintain desired relationships between the control pedals 10 such as, for example, "step over", that is, the forward position of the accelerator pedal relative to the brake pedal. It is noted however, that individual adjustment of a single control pedal 10 is within the scope of the present invention.

The control pedal 10 includes a support or link 12, a pedal arm 14 supported by the link 12 and carrying a pad or pedal 16 for engagement by the foot of the motor vehicle operator, and a drive assembly 18 for moving of the pedal arm 14 relative to the link 12 to adjust the position of the pedal 16. The link 12 is sized and shaped for pivotal attachment to a mounting bracket 20. The mounting bracket 20 is adapted to rigidly attach the adjustable control pedal 10 to a firewall or other rigid structure of the motor vehicle in a known manner. The link 12 is adapted for pivotal attachment to the mounting bracket 20. The illustrated link has an opening 22 formed for cooperation with the mounting bracket 20 and an axle or pivot pin 24. With the pivot pin 24 extending through the mounting bracket 20 and the opening 22 of the link 12, the link 12 is pivotable relative to the fixed mounting bracket 20 about a horizontally and laterally extending pivot axis 26 formed by the central axis of the pivot pin 24.

The illustrated link 12 is an elongate plate oriented in a vertical plane. The link 12 is preferably formed of a suitable metal such as steel but can alternatively be formed of a suitable plastic such as NYLON. The illustrated link 12 is generally "L-shaped" having a generally vertical upper portion 12*a* which generally extends downward from the pivot axis 26 and a generally horizontal lower portion 12*b* which generally extends in a rearward direction from a lower end of the upper portion 12*a*. The link upper portion 12*a* is adapted for supporting the pedal arm 14 and for pivotal attachment of the pedal arm 14 via the pivot pin 24 as described in more detail hereinafter. The illustrated link upper portion 12*a* has an additional opening 28 formed therein which extends laterally through the entire thickness of the link 12. The additional opening 28 is an alternative pivot point for the link 12 for cooperation with the pivot pin 24 so that the same configuration of the link 12 can be utilized with more than one type of control pedal such as, for example a clutch pedal and a brake pedal. The openings 22, 28 can have other suitable locations on the link 12 within the scope of the present invention. The link lower portion 12*b* is adapted for supporting the pedal arm 14 and for selected fore and aft movement of the pedal arm 14 along the link lower portion 12*b* as described in more detail hereinafter. The illustrated link lower portion 12*b* has a slot 30 is formed therein which generally extends in a forward/rearward direction along the length of the link lower portion 12*b*. The illustrated slot 30 is rearwardly inclined, that is, the rearward end of the slot 30 is generally lower than the forward end of the slot 30 so that there is a decrease in vertical position when traveling from the forward end of the slot 30 to the rearward end of the slot 30. The link lower portion 12*b* is substantially planar or flat in the area of the slot 30 and the slot 30 is open laterally through the entire thickness of the link 12. The slot 30 is sized and shaped for cooperation with the pedal arm 14 for substantially linear forward/rearward movement of the pedal 16 over a desired adjustment range as described in more detail hereinbelow.

The link 12 is operatively connected to a control device such as a clutch, brake or throttle such that pivotal movement of the link 12 about the pivot axis 26 operates the control device in a desired manner. The link 12 can be connected to the control device by, for example, a push-pull or Bowden cable for mechanical actuation or by a sensor and electrical wire or cable for electronic actuation. The illustrated link 12 is provided with a pin 32 for connection to the control device by a mechanical actuator.

The pedal arm 14 includes upper and lower pedal arms 34, 36 operatively connected to extend and retract and thus increase and decrease the total length of the pedal arm 14 respectively. The pedal arms 34,36 are each preferably formed of a suitable metal such as steel but one or both can alternatively be formed of a suitable plastic such as NYLON.

The illustrated upper pedal arm 34 is an elongate plate oriented in a vertical plane substantially parallel to plane of the link 12. The upper end of the upper pedal arm 34 is adapted for pivotal attachment relative to the link 12. The illustrated upper pedal arm 34 has an opening 38 formed therein for cooperation with the opening 22 of the link 12 and the pivot pin 24. With the pivot pin 24 extending through the opening 22 of the link 12 and the opening 38 of the upper pedal arm 34, the upper pedal arm 34 is pivotable relative to the link 12 about the horizontally and laterally extending pivot axis 26 formed by the central axis of the pivot pin 24. It is noted that the upper pedal arm 34 can alternatively utilize a separate pivot pin to either the link 12 or the mounting bracket 20. A washer or spacer 44 is preferably provided between the link 12 and the upper pedal arm 34. The illustrated spacer 44 is sized and shaped to separate or space apart the link 12 and the upper pedal arm 34 an adequate distance for placement of the lower pedal arm 36 therebetween. The spacer 44 is formed of any suitable low friction and/or high wear resistant material such as, for example, Nylon.

The lower end of the upper pedal arm 34 is sized and shaped for cooperation with the lower pedal arm 36. The illustrated upper and lower pedal arms 34, 36 cooperate with a sliding pin and slot connection or joint for extending or retracting the lower pedal arm 34 relative to the upper pedal arm 36 in a telescopic-like manner. It is noted, however, that other suitable connections or joints apparent to those skilled in the art can be utilized such as, for example, a telescoping tube connection or a pin and socket connection. The upper pedal arm 34 has a slot 46 is formed therein which extends in a lengthwise direction along the upper pedal arm 34 and is substantially perpendicular to the pivot axis 42 of the upper pedal arm 34. The slot 46 is preferably straight or linear The upper pedal arm 34 is substantially planar or flat in the area of the slot 46 and the slot 46 is open laterally through the entire thickness of the upper pedal arm 34. The slot 46 is sized and shaped for cooperation with the lower pedal arm 36 for substantially linear extension and retraction of the lower pedal arm 36 relative to the upper pedal arm 34 over a desired adjustment range as described in more detail hereinbelow.

The illustrated lower pedal arm 36 is an elongate plate oriented in a vertical plane substantially parallel to the plane of the link 12 and the plane of the upper pivot arm 34. The upper end of the lower pedal arm is sized and shaped to fit between the link 12 and the upper pedal arm 34 and is adapted for cooperation with the upper pedal arm 34. As noted hereinabove, the illustrated upper and lower pedal arms 34, 36 cooperate with a sliding pin and slot connection or joint for extending or retracting the lower pedal arm 34 relative to the upper pedal arm 36 in a telescopic-like manner. The illustrated lower pedal arm 36 has a pair of laterally and horizontally extending pins 48, 50 for cooperation with the slot 46 of the upper pedal arm 34. The pins 48, 50 can be unitary with the lower pedal arm 36 or secured or retained thereto. The pins 48, 50 are spaced apart lengthwise along the lower pedal arm 36 a distance adequate to prevent pivoting of the lower pedal arm 36 relative to the upper pedal arm 34 but to permit sliding of the pins 48, 50 along the slot 46 to extend and retract the lower pedal arm 36 relative to the upper pedal arm 34. The pins 48, 50 and the slot 46 are preferably sized to minimize side-to-side movement of the pins 48, 50 within the slot 46 but permit lengthwise movement of the pins 48, 50 within the slot 46 so that the lower pedal arm 36 is generally movable only in a lengthwise direction relative to the upper pedal arm 34. It is noted that the pins 48, 50 can engage ends of the slot 46 to provide limits to longitudinal movement of the lower pedal arm 36 relative to the upper pedal arm 34. It is also noted that while the illustrated sliding pin/slot connection has the slot 46 formed in the upper pedal arm 34 and the pins 48, 50 extending from the lower pedal arm 36, the connection can be alternatively reversed, that is, with the slot 46 formed in the lower pedal arm 36 and the pins 48,50 extending from the upper pedal arm 34.

A guide or drive pin 52 laterally and horizontally extends from the upper end of the upper pedal arm 34 for cooperation with the drive assembly 18 as described in more detail hereinafter. The drive pin 52 extends in a direction opposite the pair of pins 48, 50 and through the slot 30 in the link 12 to the drive assembly 18. The illustrated drive pin 52 is located lengthwise along the lower pedal arm 36 between the pair of pins 48, 50. The pins 48, 50 can be unitary with the lower pedal arm 36 or secured or retained thereto. The pin 52 and the slot 30 are preferably sized to minimize side-to-side movement of the pin 50 within the slot 30 but permit lengthwise movement of the pin 52 along the slot 30. It is noted that the pin 52 can engage ends of the slot 30 to provide limits to longitudinal movement of the pedal arm 14 relative to the link 12. The drive pin extends through the slot 30 of the link 12 so that the lower pedal arm 34 is supported by the link 12 by contact of the drive pin 52 and a bottom bearing surface of the slot 30 and the lower pedal arm 34 is movable fore and aft relative to the link 12 as the drive pin 52 slides along the bottom bearing surface of the slot 30.

The lower end of the lower pedal arm 36 is sized and shaped to carry the rearward-facing pedal 16. The pedal 16 is adapted for depression by the driver of the motor vehicle to pivot the control pedal 10 about the pivot axis 26 to obtain a desired control input to the motor vehicle.

The drive assembly 18 includes a screw shaft or drive screw 54, a drive screw attachment or housing 56 for securing the drive assembly 18 to the link 12, a drive nut 58 adapted for movement along the drive screw 54 in response to rotation of the drive screw 54, an electric motor 60 for rotating the drive screw 54, and a drive cable 62 for connecting the motor 60 to the drive screw 54.

The drive screw 54 is an elongate shaft having a threaded portion adapted for cooperation with the drive nut 58. The drive screw 54 is preferably formed of resin such as, for example, NYLON but can be alternately formed of a metal such as, for example, steel. The forward end of the drive screw 54 is journaled by the drive screw housing 56 for rotation of the drive screw 54. The drive screw 56 rearwardly extends from the drive screw housing 56 generally parallel to and adjacent the slot 30 in the upper link in a cantilevered fashion. Mounted in this manner, the drive screw 54 rearwardly inclined, that is, the rear end of the drive screw 54 is lower than the forward end of the drive screw 54. The drive screw 54 can be connected to the drive screw housing 56 with a self-aligning or freely pivoting joint, that is, a joint which freely permits pivoting of the drive screw 54 relative to the drive screw housing 56 and the link 12 about at least axes perpendicular to the drive screw rotational axis 64. The self-aligning joint automatically corrects misalignment of the drive screw 54 and/or the drive nut 58. The self-aligning joint also allows the slot 30 to be nonlinear when desired. The self aligning joint can be, for example, a ball/socket type joint.

The drive screw housing 56 is sized and shaped for supporting the forward end of the drive screw 54 and attaching the drive screw 54 to the link 12. The drive screw housing is preferably molded of a suitable plastic material such as, for example, NYLON but can alternatively be formed of metal such as steel The illustrated drive-screw housing 56 is secured to the link 12 by mechanical fasteners 66. It is noted, however, that the drive screw housing 56 can be unitary with the link 12 or secured to the link 12 in other suitable manners such as, for example, a snap-fit connection.

The drive nut 58 is adapted for axial movement along the drive screw 54 in response to rotation of the drive screw 54. The drive nut 54 is preferably molded of a suitable plastic material such as, for example, NYLON but can alternatively be formed of metal such as, for example steel. The drive nut 58 is secured to the drive pin 52. The drive nut 58 is unitary with or rigidly secured to the drive pin 52 and the lower pedal arm 34 is pivotable about the drive pin 52 so that the pedal arm 14 can pivot about the pivot pin 40 by movement of the drive pin 52 along the slot 30. Alternatively, the drive pin 52 can be rigidly secured to the lower pedal arm 34 and pivotally connected to the drive nut 58. The drive pin 52 can be connected to the drive nut 58 with a self-aligning or freely pivoting joint, that is, a joint which freely permits pivoting of the drive nut 58 relative to the drive pin 52 about at least axes perpendicular to the rotational axis 64 of the drive screw. The self-aligning joint automatically corrects misalignment of the drive nut 58 and/or drive screw 54. The self aligning joint can be, for example, a ball/socket type joint.

The electric motor 60 can be of any suitable type and can be secured to the firewall or other suitable location such as, for example, the mounting bracket 20. The drive cable 62 is preferably a flexible cable and connects the motor 60 and the forward end of the drive screw 54 so that rotation of the motor 60 rotates the drive screw 54. It is noted that the drive screw 54 and the motor 60 can be alternatively connected with a rigid connection. An input end of the drive cable 62 is connected to an output shaft of the motor 60 and an output end of the drive cable 62 is connected to the end of the drive screw 54. It is noted that suitable gearing is provided between the motor 60 and the drive screw 54 as necessary depending on the requirements of the control pedal 10. It is also noted that the fixed portion or sheath of the drive cable 62 is rigidly secured to the forward end of the drive screw housing 56 and a rotating portion of the cable 62 is operatively connected to the forward end of the drive screw 54 to rotate the drive screw 54 therewith. Preferably a controller including processing means and memory means are adapted to control operation of the motor. The controller can be a dedicated controller, the motor vehicle control unit, or a controller of another system of the motor vehicle such as, for example, a keyless entry system or a powered seat system.

To adjust the control pedal 10, the driver engages a control switch which activates rotation of the motor 60 in the desired direction. Rotation of the motor 60 rotates the drive screw 54 through the drive cable 62 and causes the drive nut 58 to axially move along the drive screw 54 in the desired direction. The drive nut 58 moves along the drive screw 54 because the drive nut 58 is held against rotation with the drive screw 54 by the drive pin 52. As the drive nut 58 axially moves along the drive screw 54, the drive pin 52 moves along the slot 30 because the drive pin 52 is secured to the drive nut 58. It is noted that binding of the drive nut 54 along the drive screw 50 is minimized if a self-aligning joint is provided, between the drive screw 54 and the drive screw housing 56 and/or the drive nut 58 and the drive pin 52, to automatically align the components so that the drive nut 58 can smoothly travel along the drive screw 54. As the drive pin 52 slidingly moves along the link slot 30, the lower pedal arm 36 is moved therewith to adjust the forward/rearward position of the pedal 16. As the lower pedal arm 36 is moved by the drive pin 52, rearward/forward movement of the drive pin 52 pivots or rotates the pedal arm 14 relative to the link 12 about the pivot pin 24. Additionally, downward/upward movement of the drive pin 52 extends or retracts the lower pedal arm 36 relative to the upper pedal arm 34 to move or translate the pedal arm 14 relative to the link 12. With such movement, the pedal 16 travels in a substantially linear and horizontal path, that is, the pedal 16 moves in a forward/rearward direction and generally remains at the same height relative to the fixed mounting bracket 20 and the link 12 which does not move relative the mounting bracket 20 during adjustment of the pedal 16. FIGS. 1 and 3 show the pedal arm 14 and the pedal 16 in a full forward position in solid line and a full rearward position in broken line. It is noted that the orientation of the pedal 16 is slightly changed but the height of the pedal 14 generally remains the same. The height of the pedal 16 preferably varies less than about 0.25 inches over a total horizontal travel of about 3 inches, more preferably varies less than about 0.125 inches over a horizontal travel of about 3 inches, and most preferably varies less than about 0.06 inches over a total horizontal travel of about 3 inches. It is also noted that the link slot 30 is preferably straight or linear but may be nonlinear such as, for example, curved or arcuate to assist in obtaining a linear adjustment of the pedal. As the position of the pedal 16 is adjusted by rotating the drive screw 54, the link remains in fixed position relative to the mounting bracket 20. It can be seen from the above description that activation of the motor 60 changes the position of the pedal arm 14 relative to the link 12 but not the position of the link 12 relative to the mounting bracket 20 and therefore does not affect the connection of the control pedal 10 to the control device of the motor vehicle.

Figures 4, 5, 6:
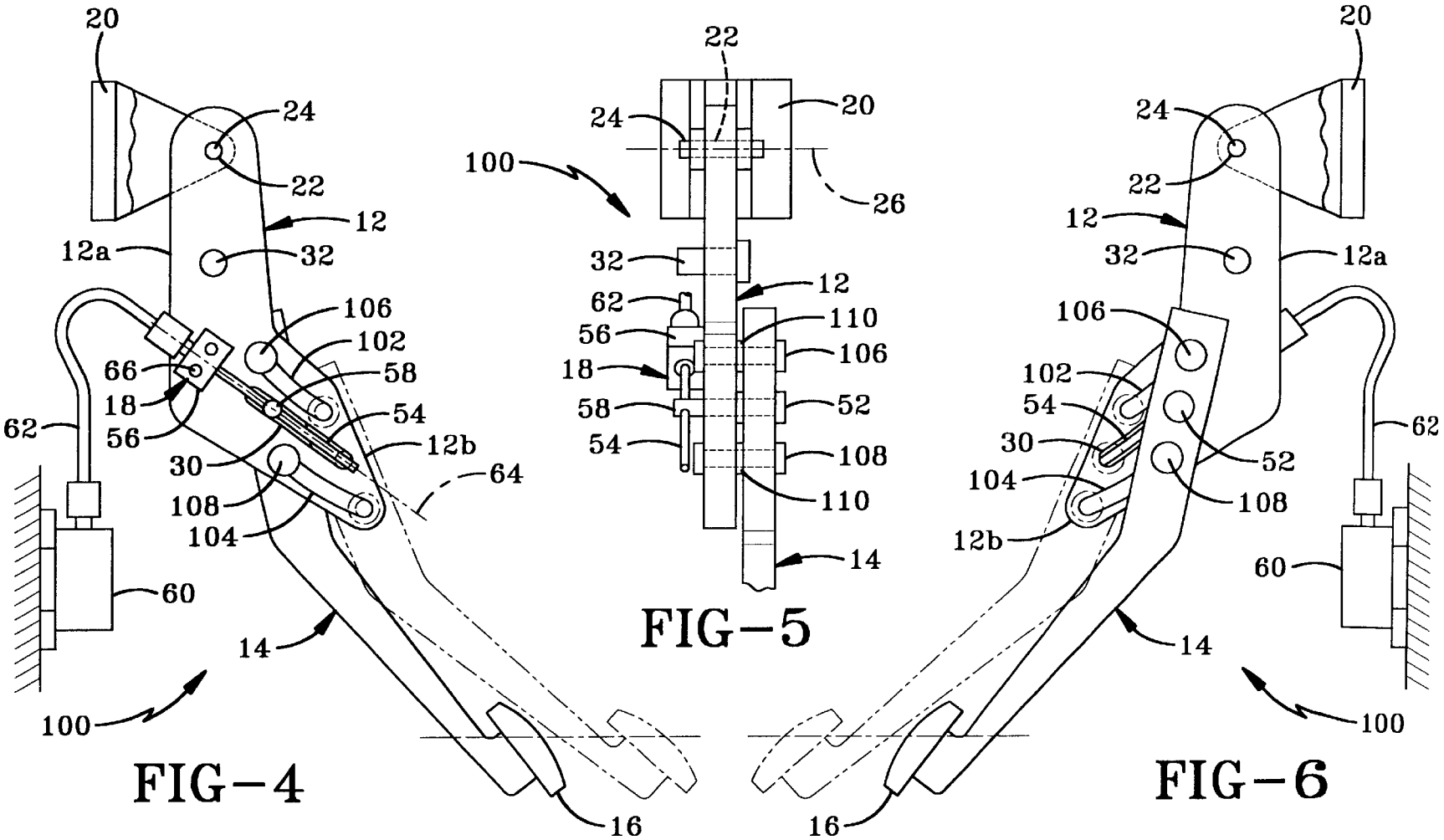
FIG. 4 is a left side elevational view of an adjustable control pedal according to a second embodiment of the present invention.
FIG. 5 is a fragmented, rear elevational view of the adjustable control pedal of FIG. 4.
FIG. 6 is a right side elevational view of the adjustable control pedal of FIGS. 4 and 5.

FIGS. 4–6 illustrate a control pedal 100 for a motor vehicle according to a second embodiment of the present invention wherein like reference numbers are used for like structure. The second embodiment is substantially similar to the first embodiment described hereinabove with reference to FIGS. 1–3, except that the pedal arm 14 is of one piece construction and utilize more than one guide pin to control the orientation and position of the pedal arm 14.

The illustrated link lower portion **12*b* has first and second guide slots 102, 104 formed therein which generally extend in a forward/rearward direction along the length of the link lower portion 12*b*. The first and second guide slots 102, 104 are preferably located above and below the drive pin slot 30 respectively. The illustrated guide slots 102, 104 are rearwardly inclined, that is, the rearward ends of the guide slots 102, 104 are generally lower than the forward ends of the guide slots 102, 104 so that there is a decrease in vertical position when traveling from the forward ends of the guide slots 102, 104 to the rearward ends of the guide slots 102, 104. The link lower portion 12*b* is substantially planar or flat in the area of the guide slots 102 and the guide slots 102, 104 are open laterally through the entire thickness of the link 12. The guide slots 102, 104 are sized and shaped for cooperation with the pedal arm 14 for substantially linear forward/rearward movement of the pedal 16** over a desired adjustment range as described in more detail hereinbelow.

The illustrated pedal arm 14 is an elongate plate oriented in a vertical plane substantially parallel to the plane of the link 12. The upper end of the pedal arm 14 is adapted for cooperation with the link 12. The illustrated pedal arm 14 has a pair of laterally and horizontally extending guide pins 106, 108 for cooperation with the guide slots 102, 104 of the link 12. The guide pins 106, 108 can be unitary with the pedal arm 14 or secured or retained thereto. The guide pins 106, 108 are spaced apart lengthwise along the pedal arm 14 a distance adequate to cooperate with the guide slots 102, 104 wherein the first or upper guide pin 106 extends into the first or upper guide slot 102 and the second or lower guide pin 108 extends through the second or lower guide slot 104. The guide pins 106, 108 and the guide slots 102, 104 are preferably sized to minimize side-to-side movement of the guide pins 106, 108 within the guide slots 106, 108 but permit lengthwise movement of the guide pins 106, 108 along the guide slots 102, 104. The guide pins 106, 108 extend through the guide slots 102, 104 of the link 12 so that the pedal arm 14 is supported by the link 12 by contact of the guide pins 106, 108 with bottom bearing surfaces of the guide slots 102, 104 and the pedal arm 14 is movable fore and aft relative to the link 12 as the guide pins 106, 108 slide along the bottom bearing surfaces of the guide slots 102, 104. It is noted that the guide pins 106, 108 can engage ends of the guide slots 102, 104 to provide limits to movement of the pedal arm 14 relative to the link 12. The guide pins 106, 108 are preferably adapted to minimize lateral movement of the pedal arm 14 relative to the link 12. Washers or spacers 110 are preferably provided on the guide pins 106, 108 between the link 12 and the pedal arm 14. The spacers 110 can be formed of any suitable low friction and/or high wear resistant material such as, for example, Nylon.

The drive pin 52 extends generally parallel to the guide pins 106, 108 and through the slot 30 in the link 12 to connect the pedal arm 14 and the drive assembly 18. The illustrated drive pin 52 is connected along the lower pedal arm 36 between the pair of guide pins 106, 108. The drive pin 52 can be unitary with the pedal arm 14 or secured or retained thereto. The drive pin 52 and the slot 30 are preferably sized for a clearance, that is, to permit side-to-side movement of the drive pin 52 within the slot 30 and to permit lengthwise movement of the drive pin 52 along the slot 30. It is noted that the drive pin 52 can engage ends of the slot 30 to provide limits to longitudinal movement of the pedal arm 14 relative to the link 12.

The guide slots 102, 104 are shaped to move the pedal 16 in a forward/rearward direction at a generally constant height as the pivot arm 14 travels along the guide slots 102, 104. In the regard, the guide slots 102, 104 are shaped to pivot the pedal arm 14 about the upper guide pin 106 as the guide pins 106, 108 travel along the guide slots 102, 104. The guide slots 102, 104 of the illustrated embodiment are curved or arcuate.

To adjust the control pedal 10, the driver engages a control switch which activates rotation of the motor 60 in the desired direction. Rotation of the motor 60 rotates the drive screw 54 through the drive cable 62 and causes the drive nut 58 to axially move along the drive screw 54 in the desired direction. The drive nut 58 moves along the drive screw 54 because the drive nut 58 is held against rotation with the drive screw 54 by the drive pin 52. As the drive nut 58 axially moves along the drive screw 54, the drive pin 52 moves along the slot 30 because the drive pin 52 is secured to the drive nut 58. It is noted that binding of the drive nut 54 along the drive screw 50 is minimized if a self-aligning joint is provided, between the drive screw 54 and the drive screw housing 56 and/or the drive nut 58 and the drive pin 52, to automatically align the components so that the drive nut 58 can smoothly travel along the drive screw 54. As the drive pin 52 moves along the link slot 30, the pedal arm 14 is moved therewith to adjust the forward/rearward position of the pedal 16. As the pedal arm 14 is moved by the drive pin 52, the guide pins 106, 108 travel along the guide slots 102, 104 to move or translate the pedal arm 14 in a forward/rearward direction relative to the link 12 and to pivot the pedal arm 14 relative to the link 12 generally about the upper guide pin 106. With such movement, the pedal 16 travels in a substantially linear and horizontal path, that is, the pedal 16 moves in a forward/rearward direction and generally remains at the same height relative to the fixed mounting bracket 20 and the link 12 which does not move relative to the mounting bracket 20 during adjustment of the pedal 16. FIGS. 4 and 6 show the pedal arm 14 and the pedal 16 in a full forward position in solid line and a fill rearward position in broken line. It is noted that the orientation of the pedal 16 is slightly changed but the height generally remains the same. The height of the pedal 16 preferably varies less than about 0.25 inches over a total horizontal travel of about 3 inches, more preferably varies less than about 0.125 inches over a horizontal travel of about 3 inches, and most preferably varies less than about 0.06 inches over a total horizontal travel of about 3 inches. As the position of the pedal 16 is adjusted by rotating the drive screw 54, the link remains in fixed position relative to the mounting bracket 20. It can be seen from the above description that activation of the motor 60 changes the position of the pedal arm 14 relative to the link 12 but not the position of the link 12 relative to the mounting bracket 20 and therefore does not affect the connection of the control pedal 10 to the control device of the motor vehicle.

From the foregoing disclosure and detailed description of certain preferred embodiments, it will be apparent that various modifications, additions and other alternative embodiments are possible without departing from the true scope and spirit of the present invention. For example, it will be apparent to those skilled in the art, given the benefit of the present disclosure, that the inclined slot can have many different forms. The embodiments discussed were chosen and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

What is claimed is:

1. A control pedal comprising, in combination:

a bracket;

a link pivotably attached to the bracket about a fixed pivot axis and having an inclined slot formed therein;

a screw supported by the link;

a motor operatively connected to the screw to selectively rotate the screw about a control axis;

a nut threadably engaging the screw and adapted to move axially along the screw upon rotation of the screw; and a pedal arm operatively connected to the nut, the pedal arm having a pedal and a pin extending into the inclined slot which moves along the slot as the nut travels along the screw, wherein the pedal arm rotates with respect to the link as the pin moves along the slot and the pedal moves along a generally linear path as the pin moves along the slot.

2. The control pedal according to claim 1, wherein the link has a single slot.

3. The control pedal according to claim 2, wherein the slot is substantially straight.

4. The control pedal according to claim 2, wherein the pin is operatively connected to the nut.

5. The control pedal according to claim 1, wherein the pedal arm comprises upper and lower pedal arms operatively connected for extension and retraction of the lower pedal arm relative to the upper pedal arm.

6. The control pedal according to claim 5, wherein the upper pedal arm is pivotally connected relative to the link.

7. The control pedal according to claim 6, wherein the pin connects the lower pedal arm and the nut.

8. The control pedal according to claim 5, wherein one of the upper and lower pedal arms has a slot and the other of the upper and lower pedal arms has a pair of pins extending into the slot for sliding movement of the lower pedal arm relative to the upper pedal arm.

9. The control pedal according to claim 1, wherein the link has a second slot formed therein and the pedal arm has a second pin extending into the second slot.

10. The control pedal according to claim 9, wherein the slot and the second slot are each arcuate.

11. The control pedal according to claim 9, wherein the pedal arm has a drive pin operatively connected to the nut.

12. The control pedal according to claim 11, wherein the drive pin extends through a third slot formed in the link.

13. The control pedal according to claim 11, wherein the third slot is formed between the slot and the second slot.

14. A control pedal comprising, in combination:

a link having a slot formed therein;

a screw supported by the link;

a motor operatively connected to the screw to selectively rotate the screw about a central axis;

a nut threadably engaging the screw and adapted to move axially along the screw upon rotation of the screw; and a pedal arm comprising upper and lower pedal arms operatively connected for extension and retraction of the lower pedal arm relative to the upper pedal arm, the upper pedal arm pivotally connected relative to the link, the lower pedal arm having a pedal and a pin extending into the slot, the pin operatively connected to the nut so that the pin moves along the slot as the nut travels along the screw, wherein the pedal arm pivots relative to the link and the lower pedal arm translates relative to the upper pedal arm as the pin moves along the slot and the pedal moves along a generally linear path as the pin moves along the slot.

15. The control pedal according to claim 14, wherein the slot is substantially straight.

16. The control pedal according to claim 14, wherein one of the upper and lower pedal arms has a slot and the other of the upper and lower pedal arms has a pair of pins extending into the slot for sliding movement of the lower pedal arm relative to the upper pedal arm.

* * * * *